United States Patent [19]

Ross et al.

[11] Patent Number: 4,540,363

[45] Date of Patent: Sep. 10, 1985

[54] INGOT PUSHER FURNACE

[75] Inventors: Robert H. Ross; Robert C. Larko, both of Meadville, Pa.

[73] Assignee: Seco/Warwick Corporation, Meadville, Pa.

[21] Appl. No.: 585,324

[22] Filed: Mar. 1, 1984

[51] Int. Cl.[3] ..... F27B 9/00; F27D 7/04; F27D 3/02

[52] U.S. Cl. ..... 432/148; 432/144; 432/145; 432/199; 432/234

[58] Field of Search ..... 432/126, 144, 145, 146, 432/148, 199, 234

[56] References Cited

U.S. PATENT DOCUMENTS

| | | | |
|---|---|---|---|
| 1,338,003 | 4/1920 | Egler | 432/234 |
| 1,677,136 | 7/1928 | Hepburn | 432/148 |
| 1,739,250 | 12/1929 | Menne | 432/124 |
| 1,749,584 | 3/1930 | Hurxthal | 34/158 |
| 1,851,913 | 3/1932 | Lange | 432/239 |
| 1,949,716 | 3/1934 | Harsch | 432/18 |
| 1,957,132 | 5/1934 | Callard | 432/74 |
| 2,120,829 | 6/1938 | Bolling | 432/49 |
| 2,198,362 | 4/1940 | Bailey | 34/12 |
| 2,325,757 | 8/1943 | Ehlers | 432/122 |
| 2,817,506 | 12/1957 | Albright | 432/78 |
| 3,236,507 | 2/1966 | McKie | 432/234 |
| 3,353,804 | 11/1967 | Suydam | 432/249 |
| 3,421,746 | 1/1969 | McCoy | 432/146 |
| 3,584,846 | 6/1971 | McCoy | 432/147 |
| 3,778,221 | 12/1973 | Bloom | 432/11 |
| 3,882,596 | 5/1975 | Kendziora et al. | 228/200 |
| 3,946,502 | 3/1975 | Daane et al. | 34/231 |
| 4,049,473 | 9/1977 | Davis, II et al. | 148/16.5 |
| 4,167,426 | 9/1979 | Snyder et al. | 148/113 |
| 4,218,213 | 8/1980 | Caspo | 432/249 |
| 4,238,122 | 12/1980 | Snyder et al. | 266/251 |
| 4,357,762 | 11/1982 | Eustacchia | 432/229 |

*Primary Examiner*—John J. Camby
*Attorney, Agent, or Firm*—Davis Chin

[57] ABSTRACT

An improved ingot pusher furnace having a base carrying a plurality of laterally slidable shoes with upper surfaces smoothly tapering into said base. A pair of side walls is connected to said base with a top wall connected to said side walls to define a heating enclosure. A pair of end walls are connected to the base, side walls and top walls, each of the end walls having a vestibule, including a pair of double doors therein. A baffle assembly is movably connected to the top wall to be held in spaced proximity from an ingot to be heated.

9 Claims, 3 Drawing Figures

INGOT PUSHER FURNACE

BACKGROUND OF THE INVENTION

The instant invention relates to an improved ingot pusher furnace for heating a work load consisting of a plurality of aluminum ingots or billets prior to rolling the ingots or billets in a rolling mill.

It is well known for one to use a furnace to effect heating of aluminum ingots, as is disclosed in U.S. Pat. No. 3,620,520 to Ross et al. for FURNACE HEATING CONTROL SYSTEM, which is assigned to the assignee of the instant application. It is also well known to provide fans within such a heating furnace in order to circulate the heating medium within the furnace to effect better heat transfer with the ingots to be heated.

However, as the demand for aluminum has continued to increase, there has been a need for larger and larger aluminum ingots to be heated. It may be appreciated that as the linear size of the ingots increases, the volume of metal contained therein increases as a cubic function thereof, while the area across which heat is transferred to the ingot only increases as the square thereof. This leads to a problem that as the ingot becomes very large, typically thirty feet long, six feet wide, and two feet thick. The prior art methods of heating the ingots are inadequate due to the fact that the outer portions of the ingot are overheated and often have a higher temperature than the center portions thereof thereby causing nonuniformities in the subsequent rolling of the ingot.

In addition, due to these heat transfer problems, it is difficult to bring the ingots to uniform rolling temperature rapidly and efficiently within the furnace. As each ingot is loaded into the furnace a large quantity of heat escapes from the furnace through the open door. A second large quantity of heat is absorbed by the relatively cold ingot. All of these conditions have a tendency to prevent the ingots from being uniformly heated.

What is needed, then, is an apparatus for improving the heat transfer characteristics of an aluminum homogenizing furnace or ingot pusher furnace so that the relatively large aluminum ingots in use today can be heated efficiently and uniformly.

SUMMARY OF THE INVENTION

An improved ingot pusher furnace for heating aluminum ingots is disclosed herein. The ingot pusher furnace comprises a base adapted to be supported above a supporting surface by a plurality of I-beams. The base includes an interior floor section having a pair of elongated rail wells formed therein which receive slidingly a plurality of tapered shoes for carrying the aluminum ingots. The elongated rail wells are divided by a raised center section and have a pair of sloping faces formed in the floor adjacent thereto in order to provide more efficient heating of the aluminum ingots. The tapered shoes and ramped rail wells provide a streamlined contour for the floor of the ingot pusher furnace which promotes uniform heating of the aluminum ingots.

A pair of vertical walls is connected to the base and a top wall or roof section is connected to the vertical walls. The base, the vertical side walls and the top wall define a heating enclosure within which the ingots are heated.

A plurality of gas burners, which are suspended from the top wall, inject heated combustion products which comprise a hot gaseous medium, into the heating enclosure. A plurality of fans are connected to the side walls and extend within the enclosure to circulate the hot gaseous medium in order to provide better heating for the aluminum ingots. A baffle assembly, having a fixed baffle support plate, is suspended from the top wall and also carries a portion of a fan shroud spaced in proximity with a plurality of fan blades. The baffle assembly includes a pair of end panels and a center panel in connection therewith. The center panel is oriented substantially parallel to the top wall of the enclosure. The end panels each have one end which is movable with the center panel in the vertical direction to accommodate various sizes of aluminum ingots. The outer ends of each of the end panels are connected to pivots so that as the center is moved vertically, the outer panels, while partially movable therewith, together with a top of the ingot to be treated, define a venturi with a section of maximum fluid velocity located at the center of the ingot thereby providing a uniform rate of temperature increase and heating across the entire ingot. The ends of the furnace enclosure are defined by a pair of vestibules, each of which include an inner door and an outer door, in order to minimize heat loss during loading and unloading of the ingots.

A principal object of the present invention is to provide a heating furnace having a movable baffle assembly which is adapted to provide uniform and rapid heating for very large aluminum ingots.

Another object of the instant invention is to provide an ingot pusher furnace having a smoothly tapering bottom adjacent the ingot carrying shoes in order to provide streamline gas flow and uniform heat transfer across the bottom of the ingot.

It is another object of the instant invention to provide an improved ingot pusher furnace having a baffle assembly in combination with a fan for providing highly uniform heating of aluminum ingots.

Other objects and uses of the present invention will become obvious to one skilled in the art upon a perusal of the following specification and claims in light of the accompanying drawings.

DESCRIPTION OF THE PREFERRED EMBODIMENTS

Figure 1:
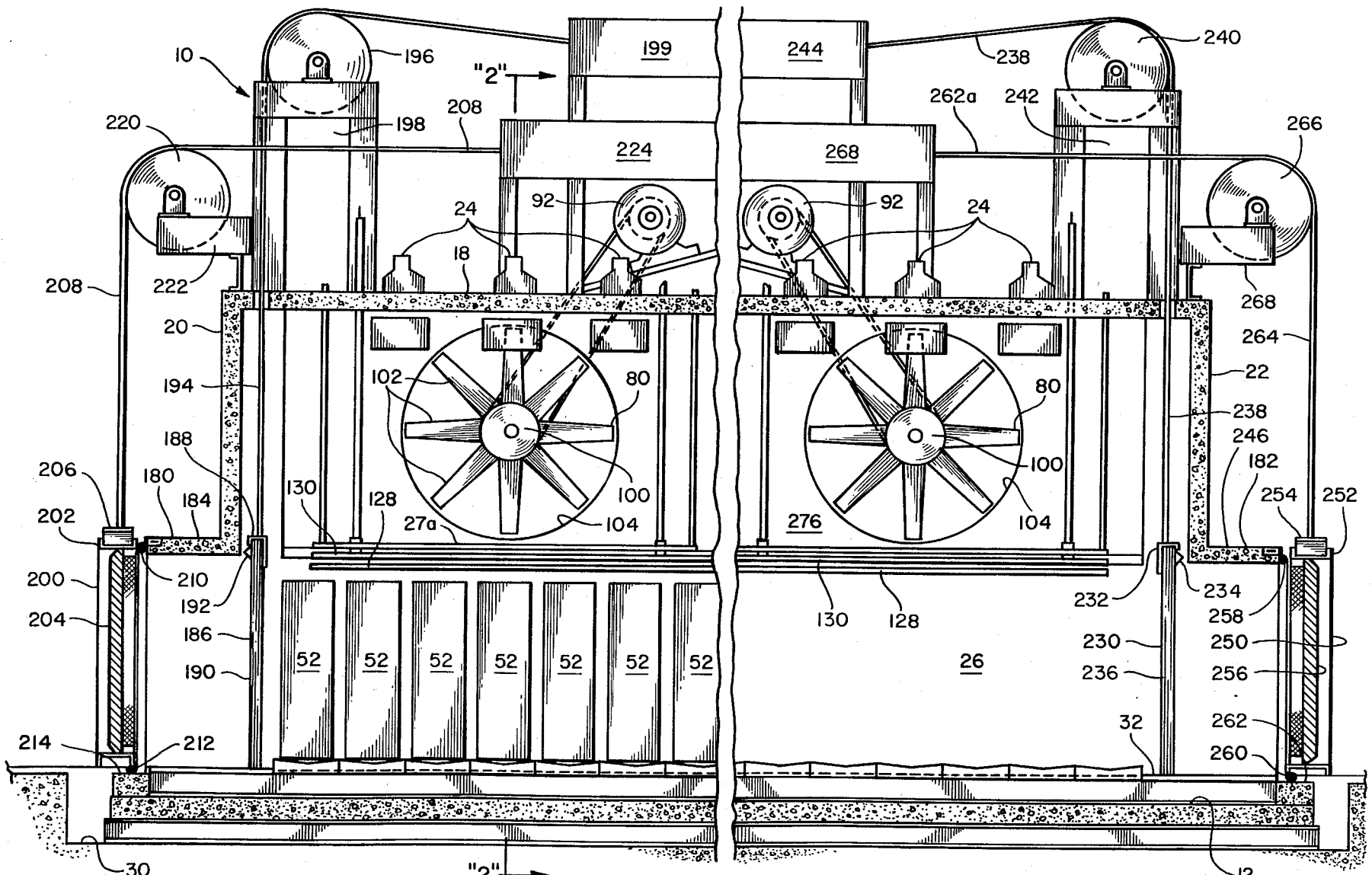
FIG. 1 is a partial section taken lengthwise of the furnace with portions thereof removed, showing details of the ingot pusher furnace embodying the present invention.

Referring now to the drawings and especially to FIG. 1, an improved ingot pusher furnaces generally indicated by numeral 10, and embodying the present invention is shown therein. The improved ingot pusher furnace includes a base 12, a pair of side walls respectively numbered 14 and 16 which are connected to the base 12, a top wall 18 connected to the side walls 14 and 16, an inlet end wall 20 connected to the base 12, the side walls 14 and 16 and the top wall 18 and an outlet end wall 22 connected to the base 12, the side walls 14 and 16 and the top wall 18. A plurality of conventional gas burners 24 are positioned in the top wall 18 and deliver a hot gaseous medium to an enclosure 26 defined by top wall 18, side walls 14, base 12, inlet end wall 20 and outlet end wall 22. In alternative embodiments of the ingot pusher furnace 10 radiant tube gas fired heaters or electric heaters may be employed to heat the enclosure 26. The enclosure 26 is divided into a plurality of heating zones respectively numbered *27a* and *27b*.

Figure 2:
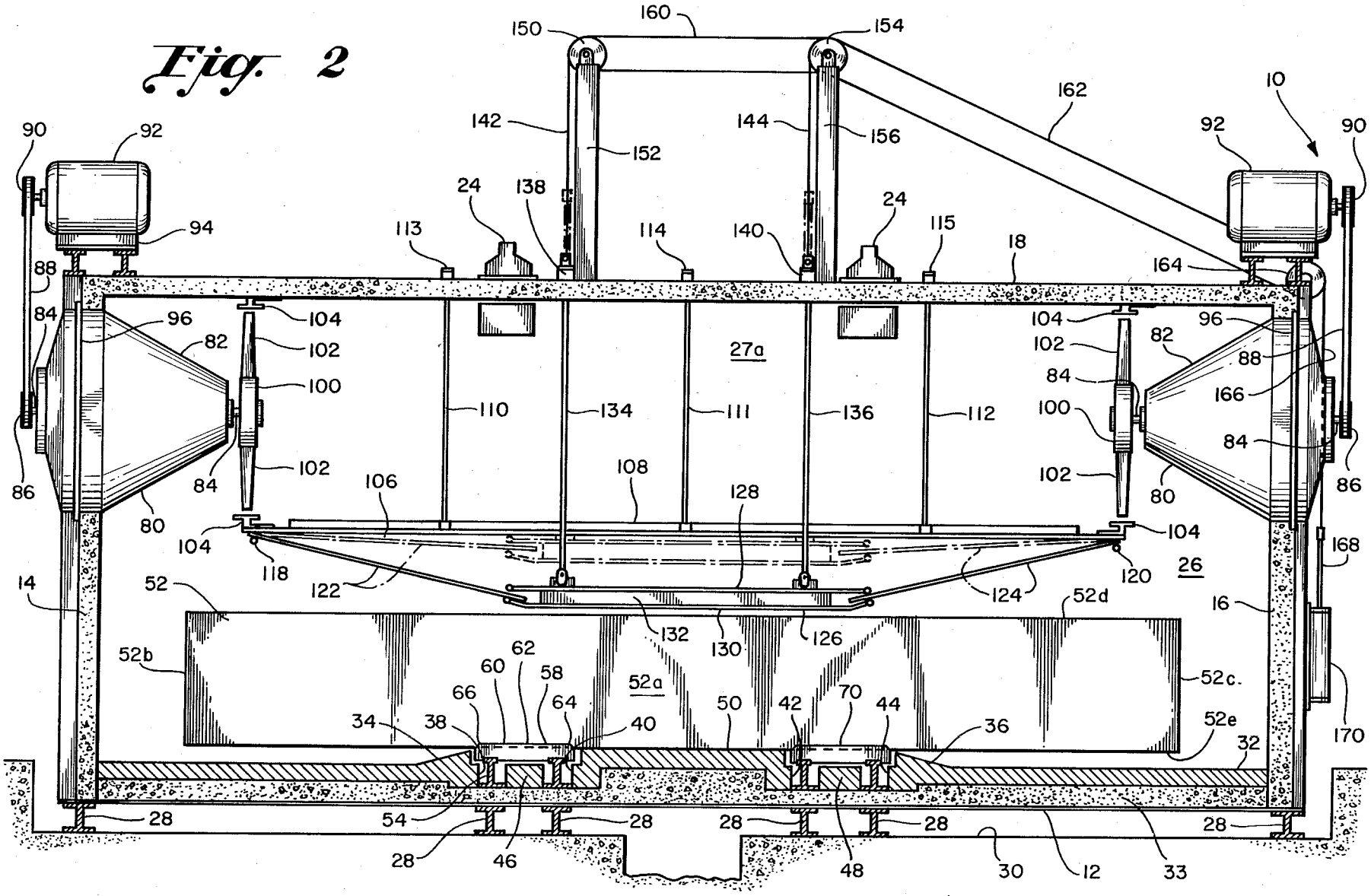
FIG. 2 is a sectional view, taken generally along line 2—2 of FIG. 1, showing details of a pair of opposed fans, a movable baffle assembly and a plurality of ingot carrying shoes of said improved ingot pusher furnace.

Referring now especially to FIG. 2, it can be seen that the base 12 is supported on a plurality of I-beams 28 which rest on a surface 30. The base 12 includes a floor 32 comprised of insulation and supported by an outer layer 33. The floor 32 extends into a pair of ramp-like tapering sections 34 and 36 which are immediately adjacent a plurality of rail wells 38, 40, 42 and 44 formed in the floor 32. The rail wells 38 and 40 are partially defined and separated by a center strip 46. The rail wells 42 and 44 are partially defined and separated by a center strip 48. It may be appreciated that immediately beneath the rail wells 38 and 40 and the rail wells 42 and 44 the outer layer 33 is somewhat less thick than it is at other locations. Between the rail wells 40 and 42 is a center floor section 50 which is substantially flush with the topmost portion of ramps 34 and 36 for reasons which will become apparent hereinafter. The rail wells 38, 40, 42 and 44 are formed in the floor 32 of the base 12 in order to facilitate the support and movement of a plurality of aluminum ingots 52 to be heated within the enclosure 26. The ingots 52 are substantially rectangular and have a center portion *52a*, an end portion *52b*, a second end portion *52c*, a top portion *52d* and a bottom portion *52e*.

The rail wells 38 and 40 receive respective rails 54 and 56 therein. Rails 54 and 56 comprise a portion of a shoe assembly 58 having an ingot receiving cross piece 60 with a top face 62 terminating in a pair of rounded shoulders 64 and 66 which effect a streamlined contour together with one of the floor ramps 34 and raised floor surface 50. Also shown in FIG. 2 is an identical shoe assembly 70 in the rail wells 42,44 having identical rails 54, 56 cross pieces 60 and top faces 62 as the shoe assembly 58. It may be appreciated that when the heated gaseous medium is moving within the enclosure 26 the ramp surfaces 34 and 36, together with the rounded shoulders 64 and 66 of the shoe assemblies 58 and 70, provide a very streamlined surface for the gaseous medium and help to provide better heat transfer between the bottom portion *52e* of each of the ingots 52 and the circulating gaseous medium, thereby promoting more uniform heat transfer and temperature throughout the aluminum ingots 52.

In order to better circulate the heated gaseous medium a plurality of fans 80 are provided. The fans are identical, each of them including a pyramidal housing 82 which receives a journaled drive shaft 84. The drive shaft 84 extends out of the pyramidal housing 82 and is connected to a pulley 86. The pulley 86 is driven by a belt 88 which is frictionally engaging a pulley 90 driven by an electric motor 92 supported on a holder 94 on the top wall 18. The pyramidal housing 82 includes a sealing ring 96 surrounding it to prevent the hot gaseous medium from escaping from the furnace. The drive shaft 84 is drivingly connected to a hub 100 which has connected thereto a plurality of fan blades 102 which when rotated move the hot gaseous medium throughout the enclosure 26. The fan blades 102 are in spaced proximity with a shroud 104, a portion of which is supported from a baffle assembly 106 which is supported by the top wall 18. Although in the embodiment disclosed in FIGS. 1 and 2 a pair of opposed fans 80 is shown in each heating zone, in other embodiments of the instant invention only a single fan would be employed.

The baffle assembly 106 includes a horizontally oriented baffle support plate 108 supported by a plurality of hanger rods respectively numbered 110, 111 and 112 which are connected by a plurality of suitable fasteners respectively numbered 113, 114 and 115 to the top wall 18. The support plate 108 carries a first pivot assembly 118 at one of its ends and a second pivot assembly 120 at the other of its ends. A baffle end panel 122 is pivotally connected to pivot 118. A baffle end panel 124 is pivotally connected to pivot 120 at one of its ends. At the other end of the end panel 122 and the other end of the end panel 124 a baffle center assembly 126, including a top plate 128, a bottom plate 130 and a spacer 132, receives the end panel 122 between the top plate 128 and the bottom plate 130 and receives the end panel 124 between the top plate 128 and the bottom plate 130. It may be appreciated that the ends of the end panels 122 and 124, since they are interfitted between the two plates, are free to slide therebetween as the center assembly 126 is moved up and down by a pair of movable support rods 134 and 136 which are supportingly connected to the top plate 128 and are received by a pair of sleeves respectively numbered 138 and 140 which are mounted on the top wall 18.

The support rod 134 is connected to a chain 142. The support rod 136 is connected to a chain 144. Chain 142 is in engagement with a pulley 150 rotatably supported by a pulley support column 152. The chain 144 is in engagement with a pulley 154 supported by a pulley support column 156. The pulley support columns 152 and 156 are mounted on the top wall 18. The pulleys 150 and 154 are joined by a chain 160. The pulley 154 is driven by a chain 162, which is in driving engagement with a pulley 164 mounted near a corner at which the top wall 18 and the side wall 16 are connected together. The pulley 164 is, in turn, driven by a chain 166 which is connected to an arm 168 in driving connection with a hydraulic cylinder 170 mounted on side wall 16, as may best be seen in FIG. 2.

Thus, the height of the baffle center assembly 126 is controlled by the hydraulic cylinder 170. This is particularly important when ingots of varying size are to be heated. It may be appreciated that when an ingot 52 is within the furnace enclosure 26 the fans 80 are activated to circulate the gaseous medium. However, due to the fact that the ingots 52 are often quite large, the center portions *52a* of the ingots 52 are often likely not to be heated as rapidly as the end portions *52b* and *52c*. In order to provide uniform heating to the entire ingot 52, the baffle assembly 106 is positioned so that the center portion 126 is positioned in closely spaced proximity with the ingot 52 and so that the end panels 122 and 124 slope down toward the center *52a* of the ingot 52. Thus, as the gaseous medium flows between the top *52d* of the ingot 52 and the baffle assembly 106, the gas velocity increases as the medium flows under the end panel 122 approaching baffle center assembly 126 and is at its maximum under the center assembly 126. The gas velocity drops as the medium flows under the end panel 124. Thus, maximum heat transfer is provided due to the highest gas velocity immediately under center panel 126, at the center portion *52a* of the ingot 52, which is usually the slowest portion of the ingot 52 to heat up. The baffle assembly 106 also tends to concentrate all of the heated gas into contact with the center 52*a* for maximum heat transfer in the portion of the ingot which requires the most heat. Since the smooth taper of the end panels 122 and 124 effects a linear heating function, the ingot 52 is heated uniformly across its width and thereby experiences a substantially uniform heating rate and temperature uniformity throughout its interior.

The dotted line showing of the baffle assembly 106 in FIG. 2 illustrates the manner in which the baffle center assembly 126 may be adjusted to accommodate a larger ingot 52. It may similarly be adjusted downwardly from the solid line showing in FIG. 2 to accommodate a smaller ingot 52.

In order to provide better temperature isolation for the enclosure 26 of the ingot pusher furnace 10, an inlet vestibule 180 is connected to the inlet end wall 20 and an outlet vestibule 182 is connected to outlet end wall 22. The inlet vestibule 180 includes a vestibule wall section 184 and an internal door 186. The internal door 186 has a frame 188 and an insulating slab 190 mounted therein. A seal 192 is connected to the frame 188. The internal door 186 is suspended from a chain 194 connected to the door frame 188. The cable 194 is engaged by a pulley 196 rotatably mounted upon a pulley support column 198. The pulley support column 198 is mounted on the top wall 18. The chain 194 is connected to a first hydraulic actuating means 199 such as a hydraulic cylinder.

When the first hydraulic means 199 is actuated, tension is placed on the chain 194 and the internal door 186 is raised. At the time, however, that the internal door 186 is raised, an inlet outer door 200 remains closed. The outer door 200 includes a frame 202 and a center insulating slab 204 mounted therein. A header 206 is connected to the door frame 202 and receives a chain 208 for support therefrom. The door insulating slab 204 terminates at a seal 210 and the door frame 202 has a bottom seal 212 adapted to engage a floor 214 of the inlet vestibule 180. The chain 208 is received by a pulley 220 which is mounted on a pulley support column 222 mounted on from the top wall 18. The chain 208 is connected to a second hydraulic means 224 such as a hydraulic cylinder, which, when activated, places tension on chain 208 and raises the outer inlet door 200. When an ingot 52 is to be introduced into the furnace 10, the second hydraulic means 224 is initially activated, raising the outer inlet door 200, and the ingot 52 is placed within the inlet vestibule 180. The second hydraulic means 224 is then de-activated, allowing the outer inlet door 200 to close and the first hydraulic means 199 is activated, opening the inner inlet door 186 and allowing the ingot 52 to be pushed into the enclosure 26 by a hydraulic pusher, not shown in the drawings, but which is conventional in the art. Each shoe assembly 58 abuttingly engages the shoe assembly 58 in front of it so that the hydraulic pusher supplies a motive force to all of the shoe assemblies 58 in the ingot pusher furnace 10. In this manner the heat does not rapidly flow out of the furnace 10 as it is being loaded.

The outlet vestibule 182 is adapted to solve similar heat loss problems when the ingots 52 are leaving the ingot pusher furnace 10. In addition, since the ingots 52 leaving the ingot pusher furnace 10 should have a uniform temperature throughout their volume, the outlet vestibule 182 prevents large amounts of cold air from rushing into the enclosure 26 when an end ingot 52 is discharged. Such influx of cold air has a tendency to upset the temperature uniformity of the next ingot 52 to be discharged, which can lead to nonuniformities in the subsequent ingot rolling process. An interior outlet door 230 having a frame 232, a seal 234 connected to the frame 232 and an insulating slab 236 mounted on the door frame 232 is connected to a lift chain 238, which is received by a pulley 240. The pulley 240 is rotatably mounted upon a pulley support column 242 mounted on the top wall 18. The lift chain 238 is received by a third hydraulic actuating means 244 mounted on the top wall 18. The door seal 234 is adapted to sealingly engage a top wall 246 of the outlet vestibule 182.

An outer outlet door 250 having a frame 252, a chain 252 connected thereto and an insulating slab 256 mounted thereon, is mounted at an exterior portion of the outlet vestibule 182. A vestibule seal 258 sealingly engages the door slab 250 and a door frame seal 260 engages a vestibule floor piece 262. A lift chain 262*a* is connected to the chain connector 254 to provide lifting force to the outer outlet door 250. The lift chain 262*a* passes over a pulley 266 mounted on a pulley support 268 which is connected to the top wall 18. The chain 262*a* is also connected to a fourth hydraulic means 268 mounted on the top wall 18.

When one of the ingots 52 is to be removed from the furnace 10, the third hydraulic means 244 is actuated, placing tension on the chain 238 and raising the inner outlet door 230 allowing the ingot 52 to be pushed into the outlet vestibule 182. The third hydraulic means 244 is then deactivated, allowing the interior outlet door 230 to close, sealing off the vestibule from the enclosure 26. Once the outlet vestibule 182 has been sealed, the fourth hydraulic means 268 is activated, placing tension on the chain 262*a* and raising the outer outlet door 250, after which the ingot 52 may be pushed out of the furnace 10 onto a suitable carrier. The fourth hydraulic means 268 is then deactivated, allowing the outer outlet door 250 to close.

It may be appreciated that the vestibules 180 and 182 provide effective thermal insulation to the enclosure 26 of the ingot pusher furnace 10.

Figure 3:
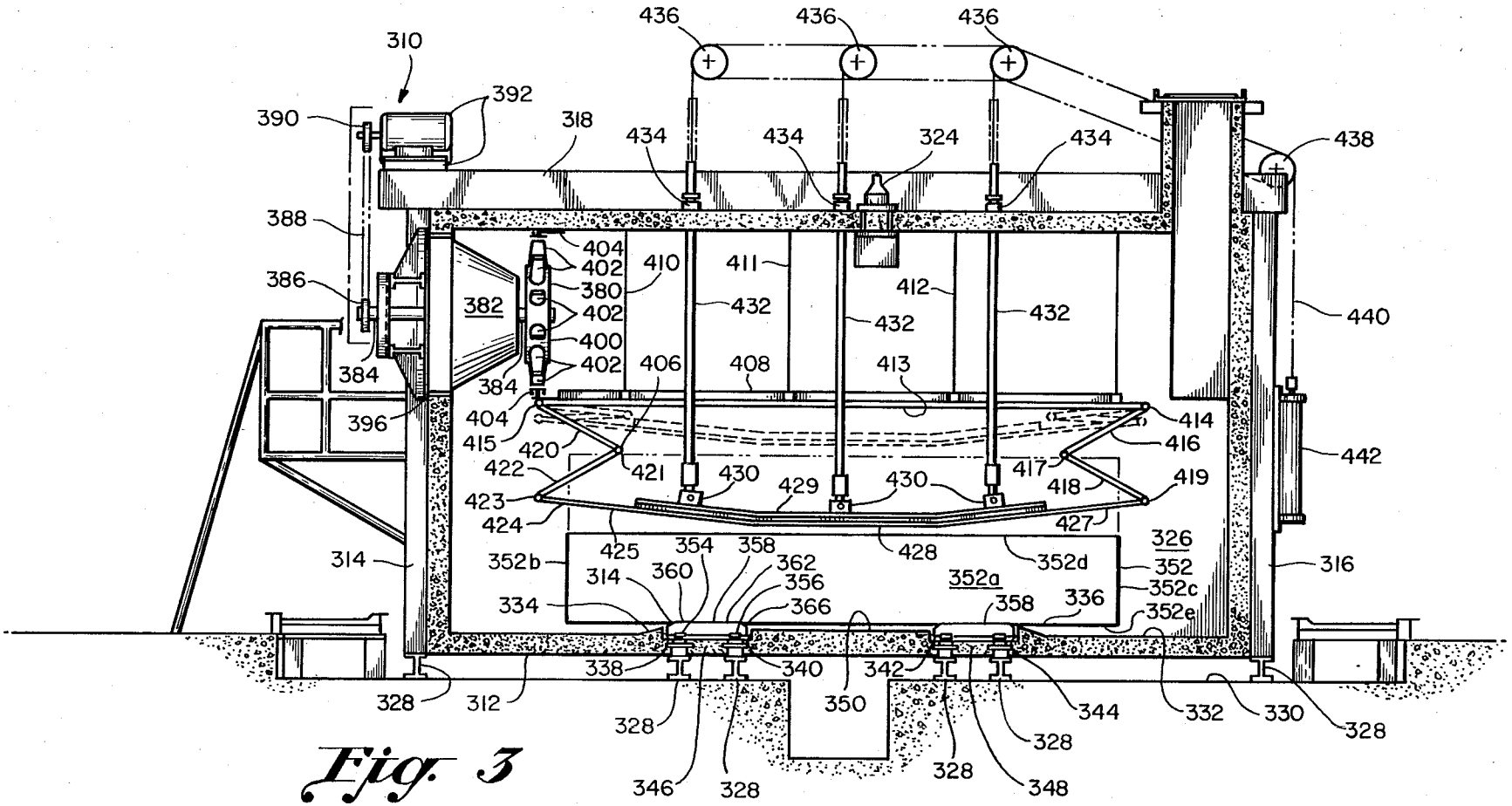
FIG. 3 is a sectional view showing details of an alternative furnace design embodying the present invention and having a pleated baffle assembly.

An alternative embodiment of the improved ingot pusher furnace 10 is shown in FIG. 3, where an improved ingot pusher furnace 310 is shown therein. The improved ingot pusher furnace 310 includes a base 312, a pair of side walls respectively numbered 314 and 316 connected to the base 312 and a top wall 318 connected to the side walls 314 and 316. A plurality of conventional gas burners, one of which is shown and identified by the numeral 324, are mounted in the top wall 318 for delivery of a heated gaseous medium to an enclosure 326 defined by the base 312, the side walls 314 and 316 and the top wall 318.

The base 312 is supported on a plurality of I-beams numbered 328. The I-beams 328 are supported on an underlying surface 330. The base 312 includes a floor 332 which extends into a pair of ramp like tapering face sections 334 and 336. Ramps 334 and 336 are immediately adjacent a plurality of rail wells numbered 338, 340, 342 and 344. The rail wells 338 and 340 are partially defined by a center floor strip 346. The rail wells 342 and 344 are partially defined by a center floor strip 348. Between the rail wells 340 and 342 is a center floor section 350, which is substantially flush with the topmost portion of the ramps 334 and 336 for reasons which will become apparent hereinafter.

The rail wells 338, 340, 342 and 344 are formed in the floor 332 of the base 312 in order to facilitate the support and movement of a plurality of aluminum ingots 352. The ingots 352 each have a center portion 352*a*, a first end portion 352*b*, a second end portion 352*c*, a top portion 352*d* and a bottom portion 352*e*. The rail wells 338 and 340 receive respective rails 354 and 356 therein. The rails 354 and 356 comprise a portion of a shoe assembly 358 having an ingot receiving cross piece 360 with a top face 362 terminating in a pair of rounded shoulders 364 and 366 which effect a streamlined contour together with the floor ramp 334 and the raised floor surface 350.

Also shown in FIG. 3 is an identical shoe assembly 358 associated with the rail wells 342, 344 and having identical surfaces and elements to shoe assembly 358 described in connection with the rail wells 338, 340. It may be appreciated that when the heated gaseous medium is moving within the enclosure the ramp surface 334, together with the rounded shoulders 364 and 366 on the shoe assemblies 358, provides a highly streamlined surface for the heated gaseous medium and help to provide better heat transfer between the bottom portion 352*e* of each of the ingots 352 and the circulating heated gaseous medium thereby promoting more uniform heat transfer throughout each of the aluminum ingots 352.

In order to better circulate the heated gaseous medium, a fan 380, is provided. The fan includes a pyramidal housing 382 which receives a journaled drive shaft 384. The drive shaft 384 extends out of the pyramidal housing 382 and is drivingly connected to a pulley 386. The pulley 386 is driven by a chain 388 which is frictionally engaged by a pulley 390 driven by an electric motor 392 supported on a holder 394 on the top wall 318. The pyramidal housing 382 includes a sealing ring 396 surrounding it to prevent the hot gaseous medium from escaping from the enclosure 326. The drive shaft 384 is drivingly connected to a hub 400 which has connected thereto a plurality of fan blades 402 which, when rotated, move the hot gaseous medium throughout the enclosure 326. The fan blades 402 are in spaced proximity with a shroud 404, a portion of which is supported from a baffle assembly 406 which is supported by the top wall 318.

The baffle assembly 406 includes a horizontally oriented baffle support plate 408 supported by a plurality of hanger rods respectively numbered 410, 411 and 412 which are secured to the top wall 318. The support plate 408 carries an upper baffle sheet 413 from which is connected a pair of end pivots respectively numbered 414 and 415. A first pivoting end plate 416 is connected at an end to the end pivot 414 and itself has a pivot 417 connected thereto. A second plate 418 is connected to the pivot 417 and has a main pivot 419 connected thereto. An end plate 420 is pivotally connected to the pivot 415 and has a pivot 421 connected opposite the pivot 415. An end plate 422 is connected to the pivot 421 and has an end pivot 423 connected therefrom. A unitary baffle facing plate 424 is connected to the pivots 423 and 419. The unitary baffle facing plate 424 is constructed of a single piece and has a pair of slanted wing sections 425 and 427, respectively connected to the pivots 423 and 419, and a center portion 428 connected between the wing portions 425 and 427 and positioned substantially parallel to the ingot 352 to be treated and the top wall 318. A baffle bracket 429, having a plurality of connectors 430 connected thereto, is affixed to the baffle plate 428.

The connectors 430 are connected to a plurality of support rods 432 which pass through the top wall 318 at a plurality of couplings 434 and are connected to a pulley assembly 436 actuable through a pulley 438 mounted at a corner of the top wall 318 and the side wall 316. The pulley assembly 436 is, in turn, actuable through a chain 440 by a hydraulic cylinder 442, in the same fashion as the baffle means are actuable or movable as shown in FIG. 2. One primary difference between the instant furnace 310, in particular, the baffle assembly 406 and the baffle assembly 106 of the previous embodiment, is that baffle 406 has the fixed contour baffle plate 424 which is movable up and down as plates 420 and 422, and 416 and 418 move in a pleated fashion to accommodate different spacings between the support plate 413 and the baffle plate 424. Thus, the contour of the venturi formed between the baffle plate 424 and the top portion 352*d* of the ingot 352 remains unchanged, allowing even greater control over the processing temperatures than is presented by the baffle assembly 106, whose contour changes as the center baffle plate is moved up and down by the baffle plate control assembly.

It may be appreciated then that the applicants have developed a novel ingot pusher furnace having an improved and enhanced heat transfer ability wherein heat transferred to the bottom of an aluminum ingot to be treated is promoted through the use of a streamlined floor and shoe assembly. Heat transferred to the top of the ingot is promoted through the use of a novel baffle assembly having a center section which is moved most closely into proximity with the center of the ingot to provide differentially more heating or heat transfer to the center of the ingot than to its end portions.

While there has been illustrated and described a particular embodiment of the present invention, it will be appreciated that numerous changes and modifications will occur to those skilled in the art and it is intended in the appended claims to cover all those changes and modifications which fall within the true spirit and scope of the present invention.

What is claimed as new and desired to be secured by Letters Patent of the United States is:

1. An ingot pusher furnace for heating an ingot comprising: an enclosure having a base, a plurality of vertical side walls connected to said base and a top wall, means for heating said enclosure by heating a gaseous medium therein; means for moving said gaseous medium within said enclosure; and a movable baffle suspended from said top wall in spaced proximity from an ingot to be heated, said movable baffle having a first portion oriented at an acute angle with an upper surface of said ingot and a second portion connected to said first portion and oriented substantially parallel to said ingot whereby said gaseous medium contained within said enclosure, when forced between said upper surface of said ingot and said movable baffle changes its velocity uniformly when between said first baffle section and said ingot and maintains a uniform velocity when traveling between said second baffle section and said ingot to effect a selected rate of heat transfer across a length of and a width of said ingot to provide uniform heating throughout said ingot.

2. An ingot pusher furnace for heating an ingot as defined in claim 1 further comprising: a pair of shoes adapted to support an ingot to be heated, each shoe having a pair of supporting rails, an ingot supporting crosspiece connected to said pair of supporting rails having a face on a top portion thereof terminating at a first end curved surface and a second end curved surface to provide a streamlined flow for said gaseous medium flowing between said base of said enclosure and an ingot carried upon said shoes.

3. An ingot pusher furnace for heating an ingot as defined in claim 1 wherein said first portion of said movable baffle comprises a first end panel and said second portion of said movable baffle comprises a center panel, said end panel being slidably interfitted with said center panel and being pivotally attached to a supporting means connected to said top wall.

4. An ingot pusher furnace for heating an ingot as defined in claim 1 wherein said first portion of said movable baffle comprises an end panel and said second portion of said movable baffle comprises a center panel, said center panel being suspended from a pair of tension support members extending from said top wall, said tension support members being adapted to move said center panel in a vertical direction in order to adjust said movable baffle for efficient heating of a plurality of ingots of various sizes.

5. An ingot pusher furnace for heating an ingot as defined in claim 1 wherein said means for moving said gaseous medium within said enclosure comprises a fan mounted upon one of said side walls of said enclosure.

6. An ingot pusher furnace for heating an ingot as defined in claim 5 wherein said first portion of said movable baffle comprises an end panel and said second portion of said movable baffle comprises a center panel suspended by a pair of tension members from said top wall.

7. An ingot pusher furnace for heating an ingot as defined in claim 1 wherein said movable baffle first portion comprises an end panel pivotally attached to a support, said second baffle section comprises a center panel slidably interfitted with said first-mentioned end panel and a second end panel is pivotally attached to said support and slidably interfitted with said center panel, said center panel being suspended from a pair of tension members which allow said center panel to be moved vertically, said movable baffle having a variable contour as said center panel is moved vertically.

8. An ingot pusher furnace for heating an ingot as defined in claim 1 wherein said baffle first portion and said baffle second portion are fixed relative to one another to provide a constant relative orientation with respect to an ingot to be heated.

9. An ingot pusher furnace for heating an ingot comprising: a base having a floor with a plurality of channels formed therein, said base being adapted to rest on a surface; a pair of side walls connected to said base; a top wall connected to said side walls and said base; said base, said side walls and said top wall defining an enclosure having a first vestibule adapted to receive an ingot for heating and a second vestibule adapted to discharge said ingot subsequent to heating, each of said vestibules including an interior door suspended from said top wall and movable vertically when actuated by a hydraulic cylinder, an exterior door mounted in spaced proximity from said interior door, said exterior door being movable vertically by a second hydraulic cylinder, said vestibule maintaining a uniform temperature within said enclosure, a plurality of heaters suspended within said enclosure to heat a gaseous medium within said enclosure to provide heating to said ingot; a baffle assembly suspended from said top wall and having a central portion movable with respect thereto, said baffle assembly including a pair of pivot end panels slidably engaging said central portion which includes a top panel, a spacer connected to said top panel and a bottom panel connected to said spacer, said end panels being oriented obliquely with respect to said top wall, said center portion being oriented to said top wall, said baffle assembly defining a venturi when said ingot for heating is located beneath said baffle assembly, a fan mounted on one of said side walls above said baffle assembly for moving said gaseous medium within said enclosure, said gaseous medium flowing between said baffle assembly and an upper portion of said aluminum ingot whereby a maximum velocity of said gaseous medium is attained immediately beneath said center portion of said baffle assembly in order to provide more rapid heat transfer at said center portion of said ingot so that said ingot is uniformly heated; and said ingot being carried on a plurality of identical shoes, each of which has a pair of rails adapted to move within said channels in said floor, an ingot carrying crosspiece connected to said rails having a pair of rounded end portions which are adapted to promote streamlined flow of said gaseous medium between said floor and a bottom portion of said aluminum ingot in order to provide good heat transfer from said gaseous medium to said aluminum ingot.

* * * * *